US005390635A

United States Patent [19]

Kidera et al.

[11] Patent Number: 5,390,635

[45] Date of Patent: Feb. 21, 1995

[54] LUBRICATING OIL SUPPLYING SYSTEM FOR ENGINE

[75] Inventors: Hiroyuki Kidera; Toru Izumi, both of Iwata, Japan

[73] Assignee: Yamaha Hatsudoki Kabushiki Kaisha, Iwata, Japan

[21] Appl. No.: 947,497

[22] Filed: Sep. 18, 1992

[30] Foreign Application Priority Data

Mar. 16, 1992 [JP] Japan ..... 4-089297

[51] Int. Cl.[6] ..... F01M 1/16

[52] U.S. Cl. ..... 123/196 R; 123/73 AD

[58] Field of Search ..... 123/196 R, 196 CP, 196 W, 123/73 AD, 506, 503, 510; 184/7.4, 6

[56] References Cited

U.S. PATENT DOCUMENTS

| | | | |
|---|---|---|---|
| 3,779,225 | 12/1973 | Watson et al. | 123/506 |
| 4,385,614 | 5/1983 | Eheim et al. | 123/506 |
| 4,396,151 | 8/1983 | Kato et al. | 123/510 |
| 4,446,833 | 5/1984 | Matsushita | 123/435 |
| 4,655,183 | 4/1987 | Taira et al. | 123/503 |
| 4,726,330 | 2/1988 | Shiga | 123/73 AD |
| 4,758,130 | 7/1988 | Waterworth | 123/196 R |
| 4,829,967 | 5/1989 | Nuti | 123/73 AD |
| 4,904,163 | 2/1990 | Tachi et al. | 417/53 |
| 4,967,700 | 11/1990 | Torigai | 123/73 AD |
| 4,989,555 | 2/1991 | Matsuo et al. | 123/73 AD |
| 5,067,459 | 11/1991 | Waddington et al. | 123/196 AB |
| 5,287,833 | 2/1994 | Yashiro | 123/196 CP |

FOREIGN PATENT DOCUMENTS 0275715 7/1988 European Pat. Off. .

OTHER PUBLICATIONS

Patent Abstracts of Japan vol. 12, No. 121 (M-686)(2968) 15 Apr. 1988 and JP-A-62 248 812 (Nippon Soken Inc) 29 Oct. 1987.

*Primary Examiner*—E. Rollins Cross
*Assistant Examiner*—Erick Solis
*Attorney, Agent, or Firm*—Knobbe, Martens, Olson & Bear

[57] ABSTRACT

A lubricating system and method of operating the system for an internal combustion engine wherein the amount of lubricant supplied to the engine from a positive displacement engine driven pump is varied by selectively delivering lubricant from the pump to the engine or bypassing the lubricant back to the return of the pump. The amount of lubricant supplied is varied by changing both the duty ratio of the lubricant supply and the duration of engine supply in response to a map of engine conditions. Various control routines are disclosed and in each the lubricant supplied to the engine is monitored so that once a finite amount of lubricant is supplied, lubricant is not supplied again to the engine until that amount previously supplied has been consumed.

70 Claims, 10 Drawing Sheets

LUBRICATING OIL SUPPLYING SYSTEM FOR ENGINE

BACKGROUND OF THE INVENTION

This invention relates to a lubricating oil supplying system for an engine and more particularly to an improved arrangement for supplying an accurate and appropriate amount of lubricant to the engine during all of its running phases.

Various systems have been proposed for lubricating internal combustion engines and proposals have been made for supplying lubricant to two cycle engines for their operation. It is desirable to be able to accurately control the amount of lubricant supplied to a two cycle engine since, as is well known, any lubricant which is not used in the lubrication of the engine will pass from the exhaust and can cause problems with emission control as well as creating undesired exhaust smoke.

It has been proposed to employ a pump for pumping the lubricant to the engine, which pump is driven in timed sequence with the engine output shaft. These pumps generally are of the reciprocating type and deliver a finite amount of lubricant during each pumping stroke. In order to control the amount of lubricant supplied by such pumps, various arrangements have been incorporated for, in effect, controlling the stroke of the pump during its operation. However, these types of lubricant flow controls make the lubricant pumps quite expensive and, in many instances, are not fully able to provide accurate control for the lubricant under all running conditions.

There has, therefore, been proposed a type of control which permits the pump to pump a full amount of lubricant each of its strokes but wherein the lubricant is selectively delivered either to the engine or bypassed back to the tank through a two-way solenoid operated valve. The amount of lubricant actually supplied to the engine is controlled by varying the duty ratio of the valve. The duty ratio is defined as the time in which the pump is delivering lubricant divided by the total operating time of the pump. Such an arrangement is disclosed in the co-pending application entitled "Lubricating Oil Supplying System for Two Cycle Engine," Ser. No. 07/862,984, filed Apr. 7, 1992 in the name of Yoshinobu Yashiro, and assigned to the assignee hereof. This invention relates to an improvement in that type of arrangement and specifically to improved control routines for controlling the duty cycle and time of pump delivery to control the amount of lubricant delivered to the engine.

FIG. 1 is a graphical view which also appears in the aforenoted co-pending application and which illustrates one of the problems with the prior art type of device wherein the plunger stroke of the lubricant pump is varied corresponding to engine speed and accelerator position. The curve "a" shows the manner in which the stroke of the pump is changed in response to engine speed changes while the curve "b" shows the actual delivery output from the pump. However, if the accelerator of the engine is opened rapidly, then the curve "c" results which provides a substantial increase in the amount of lubricant before the engine speed has actually increased. This results in excess lubricant which, at the minimum, will cause excessive hydrocarbons in the exhaust and at the maximum can additionally cause smoke to develop in the exhaust.

The aforenoted application, as discussed above, provides an arrangement wherein the pump output is controlled by varying the duty cycle of the flow controlling valve to obtain more accurate control over the amount of lubricant supplied. However, it is important to ensure that the amount of lubricant actually supplied to the engine is accurately controlled so that excess lubricant is not supplied and also so that sufficient lubricant is supplied.

It is, therefore, a principal object of this invention to provide an improved arrangement for lubricating an engine and a method for controlling the amount of lubricant supplied to the engine.

One particular problem with the control of lubricant is, as above noted, transient conditions. That is, when the engine is running at a given speed and at a given load, it is possible to accurately determine its lubricant requirements and to supply the appropriate amount of lubricant. However, when the engine speed is changed after the lubricant supply amount is determined, the amount of lubricant supplied can be incorrect.

It is, therefore, a still further object of this invention to provide an improved lubricant system and method of controlling the amount of lubricant supplied to an engine so as to accommodate transient conditions.

In conjunction with the control of fuel supplied to an engine by employing a two-way valve as aforenoted, the flow of lubricant during the time when the valve is being switched between its positions is not as great as when the valve is in its fully opened position. That is, the flow does not follow a square line shape, but rather has curved shape delivery during the opening and closing phases. As a result, the supply of lubricant does not vary completely linearly with the duty cycle of the solenoid valve. This can give rise to variations in the amount of lubricant supplied for a given condition.

It is, therefore, a still further object of this invention to provide an improved lubricant supply system and method of controlling lubricant flow wherein variations in flow in response to changes in characteristics are minimized.

The variations in lubricant supplied can be minimized if the amount of lubricant supplied to the engine is controlled primarily by extending the length of time when the valve is in its fuel delivery position rather than increasing the frequency of opening of the valve. However, if the time of lubricant delivery is the only variable that is employed in controlling the amount of lubricant, then the system may not be responsive enough under transient conditions.

It is, therefore, a still further object of this invention to provide an improved lubricant supply system for an engine which minimizes variations due to the operation of the valve but which also can respond quickly, when desired.

In connection with the supply of lubricant to an engine, it is possible to generate a three dimensional map that will indicate the actual lubricant requirements of an engine for each speed and load condition. If such a map is employed for the control strategy of the lubricant, then extremely accurate lubricant control can be achieved. However, if attempts are made to control the lubricant supply solely by controlling the amount of lubricant supplied for the engine during each cycle of operation of the pump, then the system becomes extremely complicated and it is not possible with such systems to provide the proper lubricant under all running conditions.

It is, therefore, a still further object of this invention to provide an arrangement for controlling the amount of lubricant supplied to an engine and a method therefor employing a map wherein the map is configured so as to permit accurate control of the total lubricant supplied to the engine under all running conditions with a relatively simple control strategy.

SUMMARY OF THE INVENTION

A first feature of the invention is adapted to be embodied in a lubricating system for an internal combustion engine comprising a lubricant pump and lubricant control means for controlling the amount of lubricant delivered by the lubricant pump to the engine. Sensing means sense a running condition of the engine. Means are provided for initiating the supply of an amount of lubricant by the lubricant control means determined in response to the sensed running condition of the engine sensed by the sensing means. Means are provided for changing the condition of the supply of lubricant from the lubricant control means in response to the engine condition requirements as sensed by the sensing means after the lubricant supply has begun.

Another feature of the invention is adapted to be embodied in a lubricating system for an internal combustion engine that comprises a lubricant pump and lubricant control means for controlling the amount of lubricant supplied by the lubricant pump to the engine. The lubricant control means is operative to control the amount of lubricant supplied to the engine by selectively delivering lubricant to the engine or bypassing lubricant back to a return. In accordance with this feature of the invention, the amount of lubricant supplied to the engine is varied by varying the duty cycle of the control and also the duration of time when the control is supplying lubricant.

Another feature of the invention is adapted to be embodied in a lubricating system for an internal combustion engine comprising a lubricant pump. Lubricant control means are provided for controlling the amount of lubricant delivered by the lubricant pump to the engine by varying a duty cycle of delivery of the lubricant. Means are provided for sensing an engine running condition. The time of supply of lubricant by the control means is set to be longer under one series of engine running conditions than another series of engine running conditions.

Another feature of the invention is also adapted to be embodied in a lubricating system for an internal combustion engine comprising a lubricant pump. In accordance with this feature of the invention, the lubricant pump is a positive displacement pump that is driven in timed relationship with the engine. Lubricant control means are provided for controlling the amount of lubricant delivered by the lubricant pump to the engine. Means are provided for sensing a running condition of the engine. The lubricant control means is provided with an internal map indicating the amount of lubricant to be supplied by the control means during a given time period in response to the sensed engine condition. This map has a portion that is flat so that the amount of lubricant supplied by the control means during this flat portion is the same even though the condition varies.

Another feature of the invention is adapted to be embodied in a method for controlling the amount of lubricant supplied to an internal combustion engine by a lubricating system that includes a lubricant pump. A running condition of the engine is sensed and the initiation of the supply of an amount of lubricant by the lubricant control means in response to the sensed condition of the engine prior to the initiation of lubricant supply is initiated. The supply of lubricant by the control means is discontinued once the amount of lubricant supplied for a running condition sensed after the period of supply is initiated is terminated.

Yet another feature of the invention is adapted to be embodied in a method of controlling the amount of lubricant supplied to an internal combustion engine by a lubricating system that includes a lubricant pump and a lubricant control which selectively permits the flow of lubricant from the lubricant pump to the engine or bypasses the lubricant back to a return. In accordance with this feature of the invention, the running condition of the engine is sensed and the amount of lubricant supplied is controlled by changing both the duty cycle of the control and the time period during each duty cycle when the control is in its lubricant delivery position.

Another feature of the invention is also adapted to be embodied in a method for controlling the amount of lubricant supplied to an engine by a lubricating system including a lubricant pump. Lubricant control means are provided for controlling the amount of lubricant delivered by the lubricant pump to the engine by varying the duty cycle of lubricant delivery. A running condition of the engine is sensed and during a range of the running condition, the lubricant supply period is longer than during another running condition of the engine.

A still further feature of the invention is adapted also to be embodied in a method for controlling the amount of lubricant supplied to an engine by a lubricating system including a lubricant pump. A running condition of the engine is sensed and an amount of lubricant is supplied to the engine in response to the running condition in response to a preprogrammed map. That map is preprogrammed to include a flat area wherein the amount of lubricant supplied to the engine is constant even though the running condition varies.

DETAILED DESCRIPTION OF THE PREFERRED EMBODIMENTS OF THE INVENTION

Figure 2:
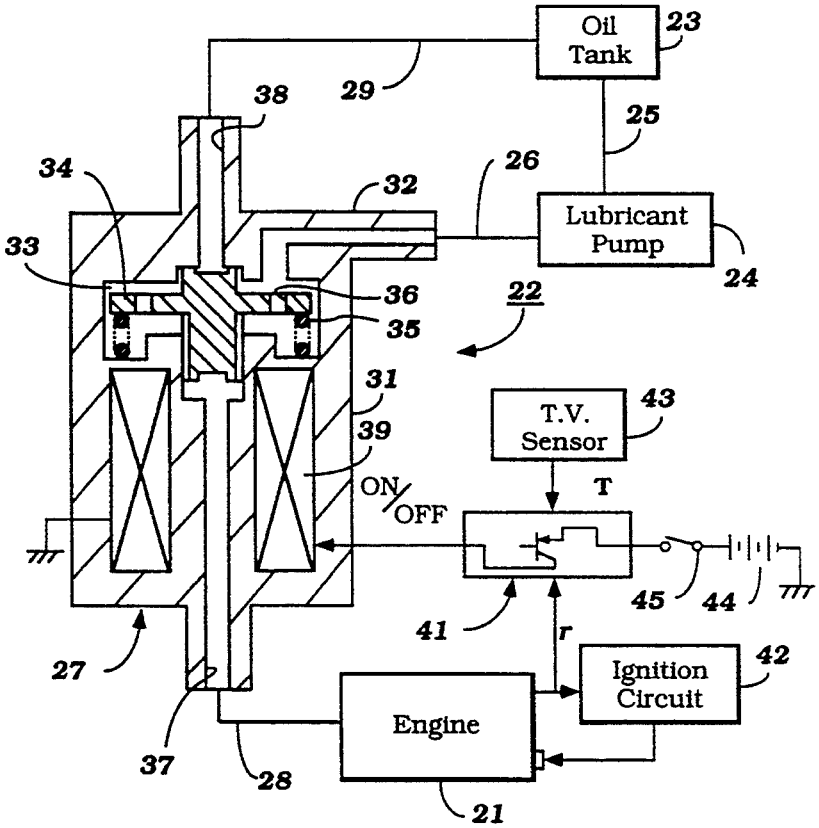
FIG. 2 is a partially schematic cross-sectional view showing the lubricant supply system in accordance with an embodiment of the invention.
Figure 3:
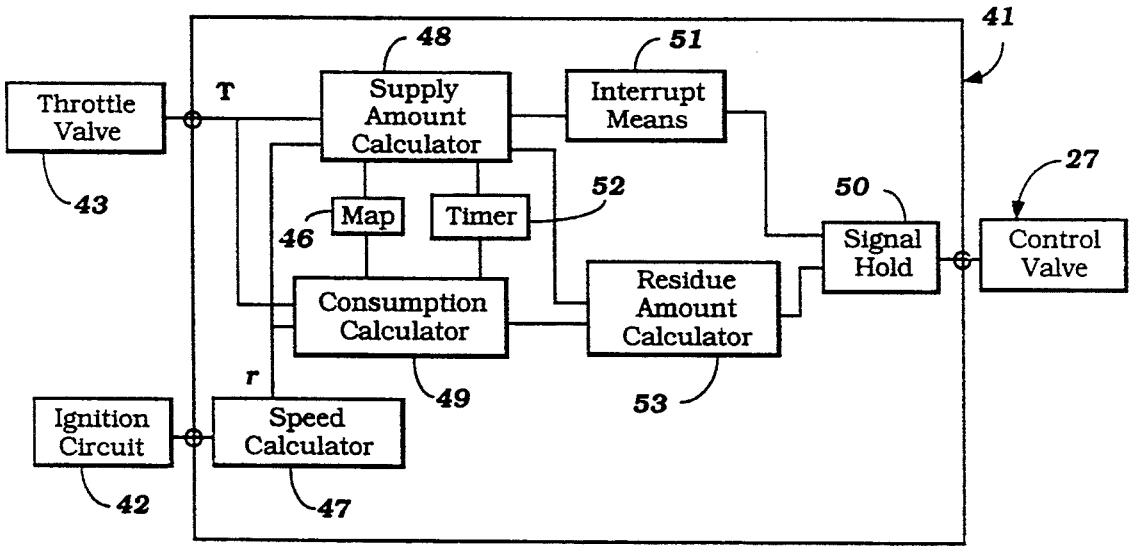
FIG. 3 is a block diagram of the lubricant supply and control system in accordance with this embodiment.

Referring in detail to the drawings and initially to FIGS. 2 and 3, an internal combustion engine is identified in block form by the reference numeral 21 and may be of any known type. The invention, however, has particular utility in conjunction with two cycle crankcase compression internal combustion engines and the engine 21 is preferably of this type. A lubricating system, indicated generally by the reference numeral 22, is provided for supplying lubricant from a lubricant tank 23 to the engine 21 for its lubrication.

The lubricant system 22 includes an engine driven pump 24 which may be of any known type but which, in accordance with a feature of the invention, is a reciprocating plunger type positive displacement pump that is driven in timed relationship with the engine 21. This pump 24 will, therefore, output a fixed amount of lubricant each time the plunger operates through a cycle. Since the pump 24 is driven by the engine 21 in timed relationship, a single rotation of the output shaft of the engine 21 will provide a fixed number of cycles or portions of cycles of the pump 24 and the total output of the pump 24 in a given unit of time will depend upon the rotational speed of the engine 21 as well as the per cycle displacement of the pump. This is important, as will become hereinafter apparent, in conjunction with a feature of the control strategy.

Lubricant flows from the lubricant tank 23 to the pump 24 through a supply line 25 and is delivered from the pump 24 through a conduit 26 to a solenoid operated control valve, indicated generally by the reference numeral 27. The solenoid operated control valve 27 is operative to either supply lubricant through a conduit 28 to the engine 21 for its lubrication or to return lubricant to the lubricant tank 23 through a return line 29. The manner in which the lubricant is delivered to the engine 21 may be of any of the known types. That is, the lubricant can be delivered to the engine 21 through its induction system and/or by direct lubrication to various components of the engine to be lubricated. As is typical with two cycle engines, if any excess lubricant is supplied to the engine 21 it will not be returned back to the tank 23, but will pass out of the exhaust of the engine 21. For this reason, it is important to ensure that the engine 21 is only supplied with the amount of lubricant necessary for its lubrication. Excess lubricant will create exhaust emission problems and/or exhaust smoke whereas inadequate lubrication can cause damage to the engine 21.

The solenoid operated lubricant control valve 27 includes a housing assembly 31 having an inlet fitting 32 that receives lubricant from the conduit 26 and delivers it to an interior chamber 33 in which a control valve element 34 is supported for reciprocation. The control valve element 34 is biased by a coil compression spring 35 into a normally open supply condition wherein lubricant can flow from the chamber 33 through openings 36 in the valve 34 to a supply conduit 37 which communicates with the conduit 28 for delivery of lubricant to the engine 21.

In this delivery position, the control valve element 34 closes a return passageway 38 also formed in the housing 31, and which communicates with the return line 29. A solenoid winding 39 is provided in the housing assembly 31 and cooperates with the valve element 34, which acts like an armature, and when energized will draw the valve element 34 down from the position shown in FIG. 2 to a position wherein the supply passage 37 is closed and the return passage 38 is open. Under this condition, lubricant will be passed back to the lubricant tank 23 through the return conduit 29.

The ratio of time when the valve element 34 is in the supply position as shown in FIG. 2 to the total time of a given cycle (opened and closed) is defined as the duty ratio. A one hundred percent duty ratio would be a condition wherein the control valve element 34 was always open during one cycle of operation.

The actuation of the solenoid winding 39 is controlled by means of a control unit, indicated generally by the reference numeral 41, and having internal components as will be described in conjunction with FIG. 3. This control unit 41 receives input signals indicative of certain engine running conditions. In the illustrated embodiment, these conditions are engine speed as sensed by an output signal, indicated by the character "r" from an ignition circuit 42 of the engine 21, the engine 21 being spark ignited. In addition, a load or throttle valve position signal "T" is supplied to the control unit 41 from a throttle valve position sensor 43 which senses the position of the throttle valve of the engine 21.

Figure 1:
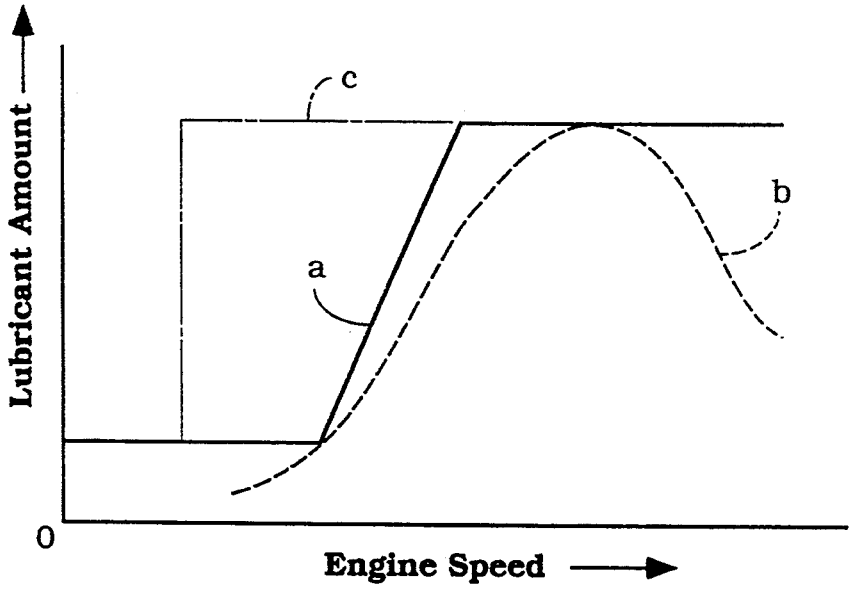
Figure 1 Prior Art
FIG. 1 is a graphical view showing the prior art type of construction and relationship of lubricant supply and demand amount in relation to engine speed.

The control unit 41 completes a circuit to the winding 39 from a battery 44 and through a main switch 45. Basically, the circuit is such that when the main switch 45 is closed, a switching device such as an SCR will be maintained in its "off" condition so as to de-energize the winding 39 and leave the solenoid control valve 27 in its lubricant supply position as shown in FIG. 1. However, when the control unit changes its state, the SCR will switch and the winding 39 will be energized to cause recirculation of the lubricant back to the tank 23 through the return passage 38 and return conduit 39.

Figure 4:
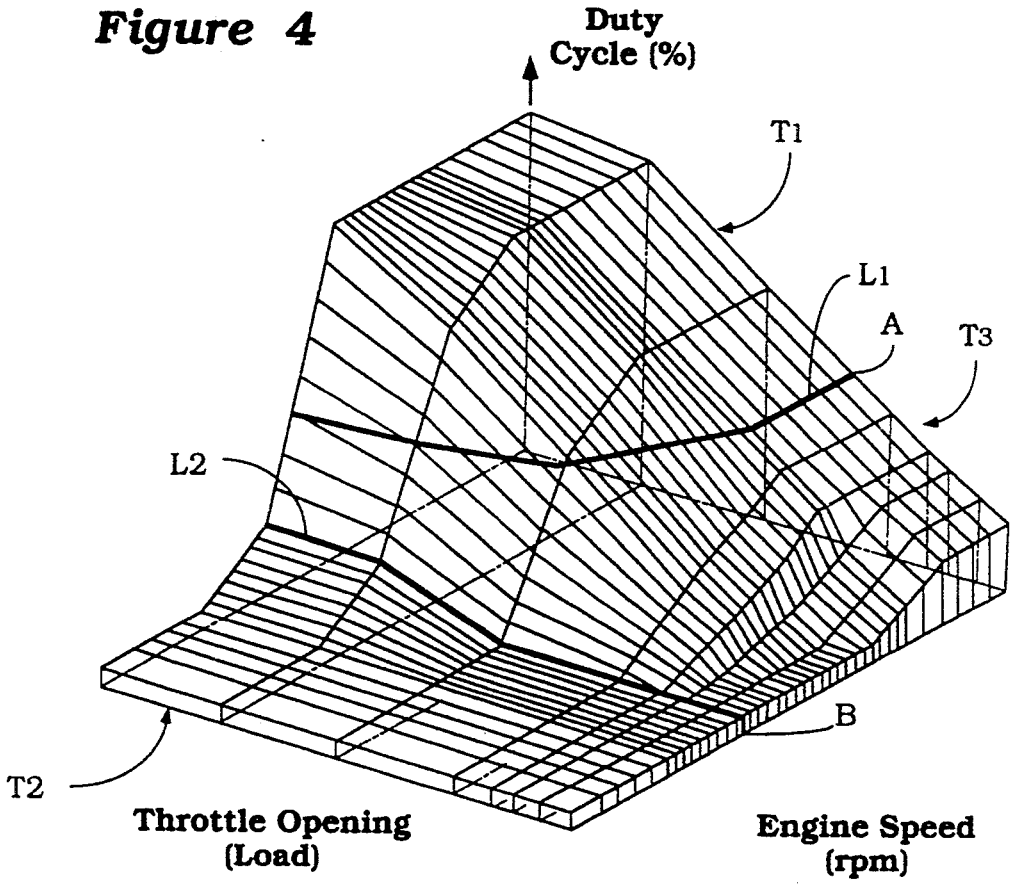
FIG. 4 is a map showing the duty cycle in relation to engine speed and throttle opening or load in accordance with this embodiment.
Figure 5:
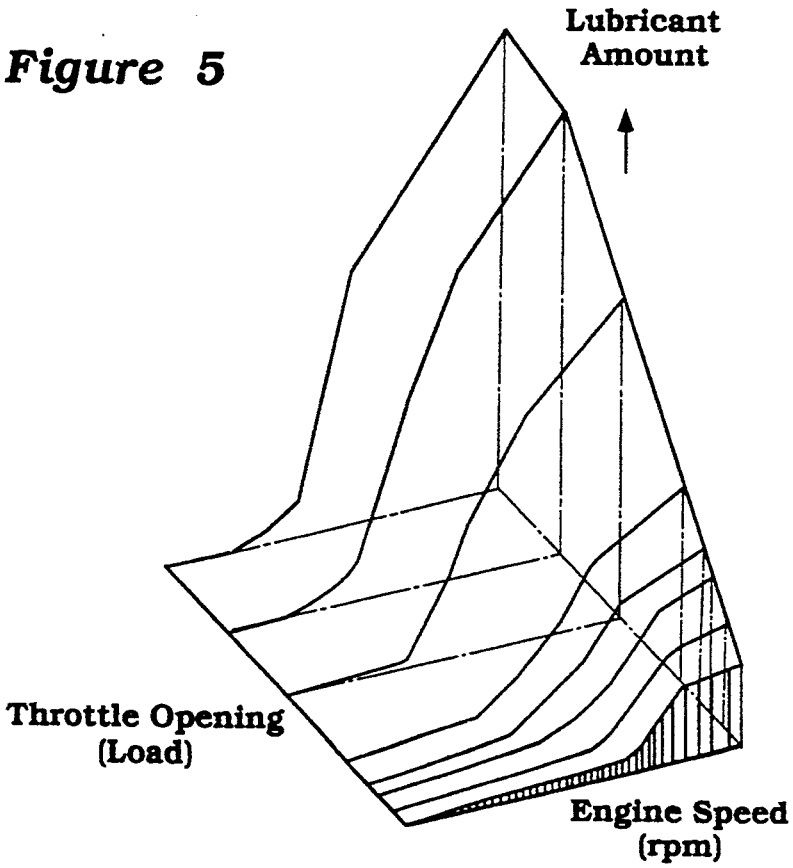
FIG. 5 is a graphical view of a map showing the actual amount of lubricant supplied in response to engine speed and throttle opening and/or load.

Referring now in detail primarily to FIG. 3, the control unit 41 includes a number of components including an internal map 46 which may be stored on a device such as an ROM and which, in one embodiment, has a configuration as shown in FIG. 4. This map is generated to set the duty cycle of the solenoid control valve 27 so as to provide the desired amount of lubricant for the engine as shown in FIG. 5. The maps of FIGS. 4 and 5 are determined by actual measurements on the engine 21 as to its lubricant requirements under all speed and throttle settings.

Information is supplied, as aforenoted, to the control unit 41 from the throttle valve position sensor 43 and from the ignition circuit 42. The ignition circuit 42 outputs its signal to a speed calculator unit 47 of the control unit 41 which converts the pulses from the ignition circuit into a speed information signal. This information is, in turn, transmitted to a supply lubricant amount calculator 48 and a consumption amount calculator 49, both of which also receive information from the map 46. The signals are processed and then are transmitted to an interrupt driver 51 which controls the aforenoted SCR so as to switch the solenoid winding 39 of the control valve 27 between its energized non-flow position and its non-energized flow position through a holding circuit 50.

The control unit 41 also includes a timer 52 that runs and resets during fixed time intervals and which outputs its signal to the calculators 48 and 49 so as to provide the necessary time signals. In addition, as will be noted, the lubricant is supplied to the engine during the time when the interrupt means 51 has the control valve in its flow position and then shuts off the supply after the time has run. The difference between the amount of lubricant supplied and the lubricant consumed is processed in a residue amount calculator 53 so as to provide control for the lubricant.

Basically the strategy operates in accordance with a procedure wherein the running condition of the engine is sensed immediately prior to the switching off of the solenoid 39 and the initiation of supply of lubricant by the control valve 27. Lubricant supply is then begun and a fixed time interval is set for the interrupt driver 51 so as to again switch the solenoid 39 on after the time period when the calculated amount of lubricant will have been delivered. However, the system continually monitors engine running condition and if the running condition changes, the interrupt means 51 is switched so as to turn the solenoid 39 back on when the actual necessary amount of lubricant has been supplied. The residue amount calculation device 53 is employed, in a manner which will become apparent, so as to continually monitor the system and ensure that the minimum amount of lubricant necessary for the actual running condition is supplied so as to avoid hydrocarbon emissions and smoke in the exhaust of the engine.

In a preferred embodiment of the invention, the timer 52 sets out a timing signal with a time such as 80 milliseconds to the interrupt driver circuit 51. The interrupt driver counts the number of such time signals so as to supply the necessary lubricant. For example, if the engine is operating at idle and it is determined that the necessary lubricating oil supply period is 960 milliseconds, then a set value of 12 is inserted into the interrupt means so that the time when the control valve 27 is supplying lubricant will be the period of 960 milliseconds.

As should be readily apparent, the amount of lubricant supplied to the engine will be dependent upon not only the duty ratio of the control valve 27, but also the total time when the control valve 27 is placed in its flow supplying position. The control strategy is such so as to provide accurate control by varying not only the duty ratio but also the time T when the control valve is in its opened position.

Figure 6:
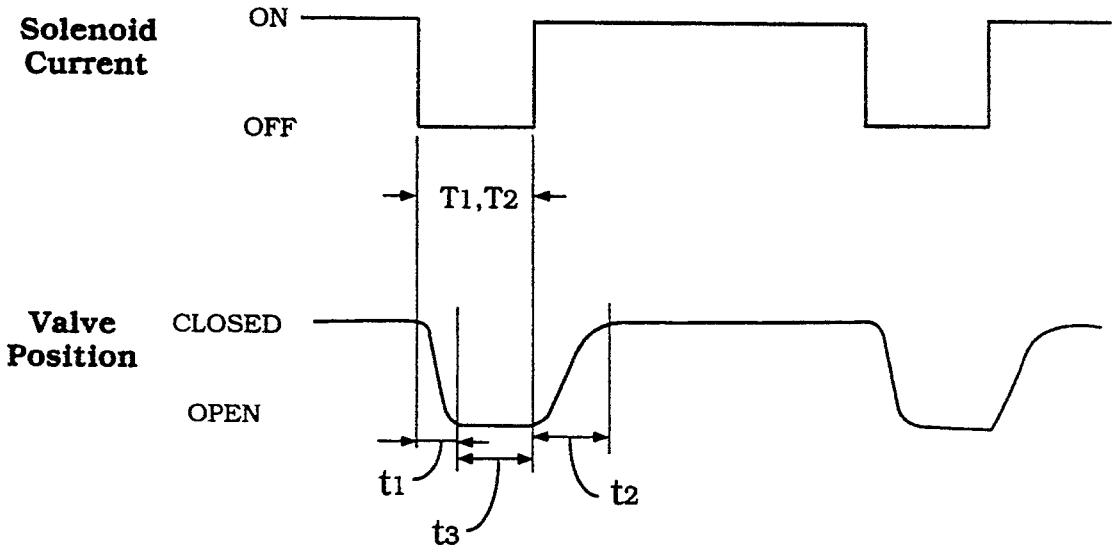
FIG. 6 is a graphical view showing the actuation of the solenoid control valve and the amount of flow through the valve during a running condition of the engine.
Figure 7:
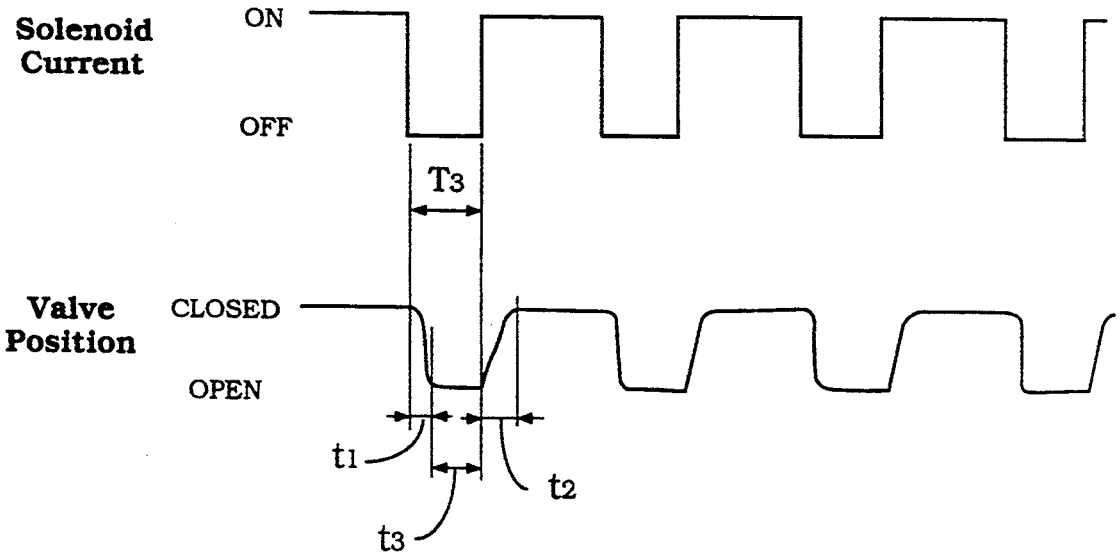
FIG. 7 is a graphical view, in part similar to FIG. 6, showing the characteristics during another running condition of the engine.

This may be understood by reference to FIGS. 6 and 7 which show two different types of control strategies which are employed in conjunction with the engine of this embodiment. The first curve of FIG. 6 shows a condition when there is a long time of valve maximum opening, indicated as $T_1$ or $T_2$, which times are illustrated as being substantially the same, but it is understood that the times $T_1$ and $T_2$ may be different from each other. As will be noted, at the time when the solenoid 39 is switched from its "on" to its "off" position, there will be a time delay $t_1$ between when the solenoid is switched off and until the valve element 34 is in its fully opened position. This delay is caused first by a time delay before any movement occurs after switching and also the time required for the valve element 34 to move from its fully closed bypass position to its fully opened supply position. In a similar manner, when the solenoid current for the solenoid 39 is switched back on, there will be another time delay $t_2$ before the valve element 34 moves to its fully closed bypassing condition. Thus the valve element 34 is in the fully opened position for a time period $t_3$ which is less than the time $T_1$ or $T_2$.

As a result of these time delays, the amount of lubricant supplied will vary from that if the valve element was in its fully opened position for the time $T_1$ or $T_2$. If long supply periods are maintained, as is the time periods $T_1$ and $T_2$, then the amount of hysteresis effect in the opening and closing of the valve will be minimized and more accurate control of the lubricant can be supplied. However, when a long supply period is chosen, it is difficult to provide rapid changes in the amount of lubricant supplied when the engine is in a transient condition. Therefore, there is another control strategy period as shown in FIG. 7 when the time $T_3$ of valve opening is less than the time $T_1$ and $T_2$. Again, there are the time delays $t_1$ upon opening and $t_2$ upon closing. However, it is possible to change the amount of lubricant being supplied more quickly in response to changes in engine condition under this control mode.

The application of this principle may be seen best in FIG. 4 wherein it will be noted that the map is divided into three control phases with the phases $T_1$ and $T_2$ being used, respectively, under high speed high throttle opening conditions and low speed low throttle opening conditions, respectively. These conditions require greater accuracy in control because of the desire to maintain low lubricant flow under idle speed while maintaining adequate lubricant to avoid smoke and hydrocarbon emissions and adequate lubrication under high speed conditions to avoid inadequate lubrication, while at the same time ensuring that hydrocarbon emissions and smoke are maintained. These areas $T_1$ and $T_2$ are defined by planes $L_1$ and $L_2$ of the map which divide the control phases along lines A and B, respectively. The plane $L_2$ is generally defined at a fixed engine speed and regardless of throttle opening while the plane $L_1$ is defined generally by a fixed duty ratio regardless of speed or throttle valve opening.

The mid-range control phase indicated by the designation $T_2$ is in intermediate speed and load (throttle) positions wherein transient conditions are more likely to occur and wherein it is more desirable to maintain a shorter duration of valve opening while, at the same time, assuring that transient conditions can be quickly responded to. It should be understood that in each of the control phases $T_1$, $T_2$ and $T_3$, the amount of lubricant supplied is determined by the duty cycle as well as the fixed times $T_1$, $T_2$ and $T_3$ of actual valve opening. This construction and the effect of it will be described later by reference to FIGS. 10–15.

It should also be noted that the duty cycle at the high speed high load range is set to be one hundred percent over a fairly flat area as shown in the map in FIG. 4. In a like manner, the low speed low throttle opening domain also has a fairly flat area where the duty cycle is fixed at its lowest amount. Even though the duty cycle and duration $T_1$ or $T_2$ are maintained constant under these conditions, the amount of lubricant supplied will vary to provide a lubricant supply as shown in FIG. 5. The reason for this is that the number of pumping cycles also will change with engine speed so that even though the duty ratio and time of valve opening is held constant, more lubricant will be supplied when the engine is running faster than when slower. Because of this choice of flat areas of the map, it is possible to obtain greater control accuracy with a minimum number of variables to be programmed into the system.

Before now describing the control routine, some further description of how the various portions of the control unit 41 operate will be described by reference to FIG. 3. It has been previously noted that the supply amount calculator unit 48 has a means for calculating the amount of lubricating oil supplied to the engine. This is done by calculating the number of pumping strokes of the pump 24 that occur during the time when the solenoid 39 is in its off condition and the control valve 34 is in its open supply condition. Hence, this calculator 48 only requires indication of the speed signal and an indication of the duration of time when the interrupt means 51 is interrupting the supply of electrical current to the coil winding 39.

The consumption calculator 49, on the other hand, calculates the actual amount of lubricant consumed by the engine. This makes a consumption calculation based upon the consumption of lubricant during the time when the solenoid coil 39 is in its energized position and the control valve 34 is in its bypassing position so that lubricant is not being supplied to the engine. This is done by calculating the amount of lubricating oil consumed per unit of time based upon information from the map 46 dependent upon engine speed and throttle opening and also the lapse of time occurring after the starting operation of the interrupting means 51.

The residue amount calculating means 53 operates to compare the amount of fuel supplied by the supply amount calculator 48 and the consumption amount by the consumption calculator 49 and determines the residue lubricant. When the residue lubricant reaches 0, then the solenoid winding 39 is again de-energized to open the control valve 34 and permit the supply of lubricant to the engine 21.

The residue amount calculating means 53 also includes an integrating circuit for integrating the difference between the supply amount and the consumption amount and determining whether the lubricating oil bypass period is longer or shorter than a predetermined time and when it is longer than this predetermined time, the solenoid 39 is de-energized regardless of the integration results to prevent the lubricating oil bypass period to become longer than a predetermined amount for any reason.

With this information in mind, the control routine will now be described by reference to FIGS. 8 and 9 with initial reference being made to FIG. 8. As may be seen from FIG. 8, the program is started when the main switch 45 is turned on and the program then moves to the step $P_1$ to re-set the control unit 41. At the same time, the program moves to the step $P_2$ to re-set the timer 52 and the accumulated trigger number therein. This is re-set to 0.

Once the control unit 41 and timer 52 has been reset, the program moves to the step $P_3$ to read the engine conditions so as to determine the lubricant supply period. At the step $P_3$, the engine speed r is supplied to the supply amount calculator 48 from the speed calculator 47 which, as noted, receives a signal from the ignition circuit 42. In addition, the throttle valve position T is received from the throttle valve 43. The program then moves to the map of FIG. 4 at the step $P_4$ so as to determine the duty cycle and also the lubricant supply period based upon these conditions.

Figure 9:
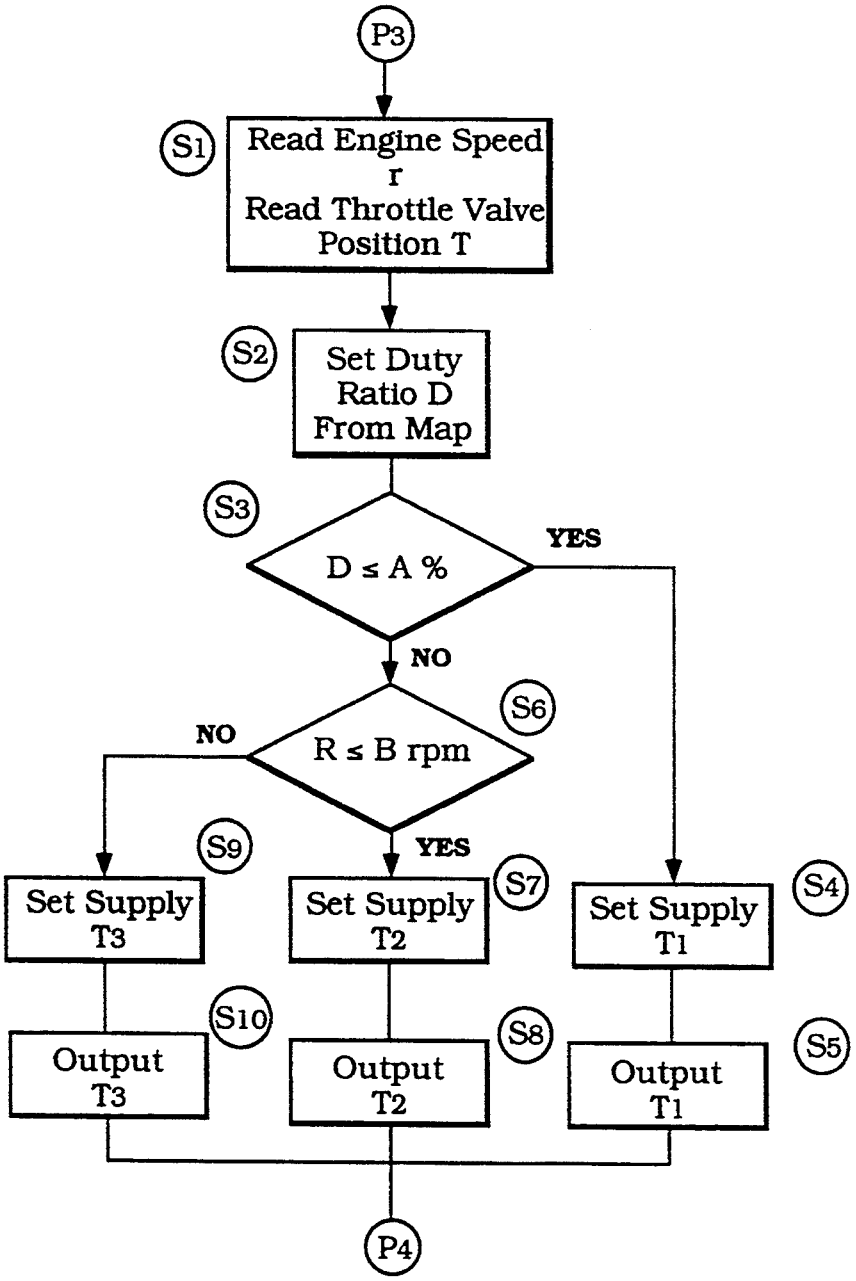
FIG. 9 is a block diagram showing a portion of the control routine by which the supply time period is selected.

The way this is done may be best understood by reference to FIG. 9. As seen in this figure, once the step $P_3$ has been completed, the program moves to the step $S_1$ to read engine speed r and throttle valve position T. The program then moves to the step $S_2$ to consult the map 46 and select a duty ratio D based on the engine speed and throttle opening for the current engine operating condition. The program then moves to the step $S_3$ to determine if the set duty ratio D is less than or equal to the duty ratio of the line A in the map of FIG. 4 to determine whether the control domain should be set to the domain $T_1$ or one of the domains $T_2$ or $T_3$ which will determine the time at which the solenoid coil 39 is maintained in its off condition so as to control the time of lubricant supply.

If the duty ratio D is greater than or equal to A, the program moves to the step $S_4$ so as to set the supply period $T_1$. The program then moves to the step $S_5$ so as to output this supply period $T_1$ to the program appearing in FIG. 8 at the step $P_4$.

If, however, the duty ratio D is not greater than that defined by the line A, the program moves to the step $S_6$ to determine whether the supply period $T_3$ or the supply period $T_2$ should be chosen. This is accomplished at the step $S_6$ to determine if the engine speed r is less than or equal to the speed set by the line B on the map 4. If the speed r is less than that defined by the line B on the map of FIG. 4, the program moves to the step $S_7$ so as to set the supply period time $T_2$. If the supply period $T_2$ is set at the step $S_7$, the program outputs this signal at the step $S_8$ and proceeds to the step $P_4$ of FIG. 8.

If, however, the engine speed r is not less than or equal to the speed B of FIG. 4 as determined at the step $S_6$, the program moves to the step $S_9$ so as to set the supply period $T_3$. The program then moves to the step $S_{10}$ to output this set time period $T_3$ and moves on to the step $P_4$.

Thus, from the foregoing description of FIG. 9, it should be readily apparent how the control unit 41 functions to determine which of the supply time periods $T_1$, $T_2$ or $T_3$ from FIG. 4 are outputted in the control unit 41 so as to set the lubricant amount strategy. Hence, it should be readily apparent that the control strategy is such that the initial amount of lubricant to be supplied to the engine is determined by the running condition immediately prior to when the calculation is being made.

Figure 8:
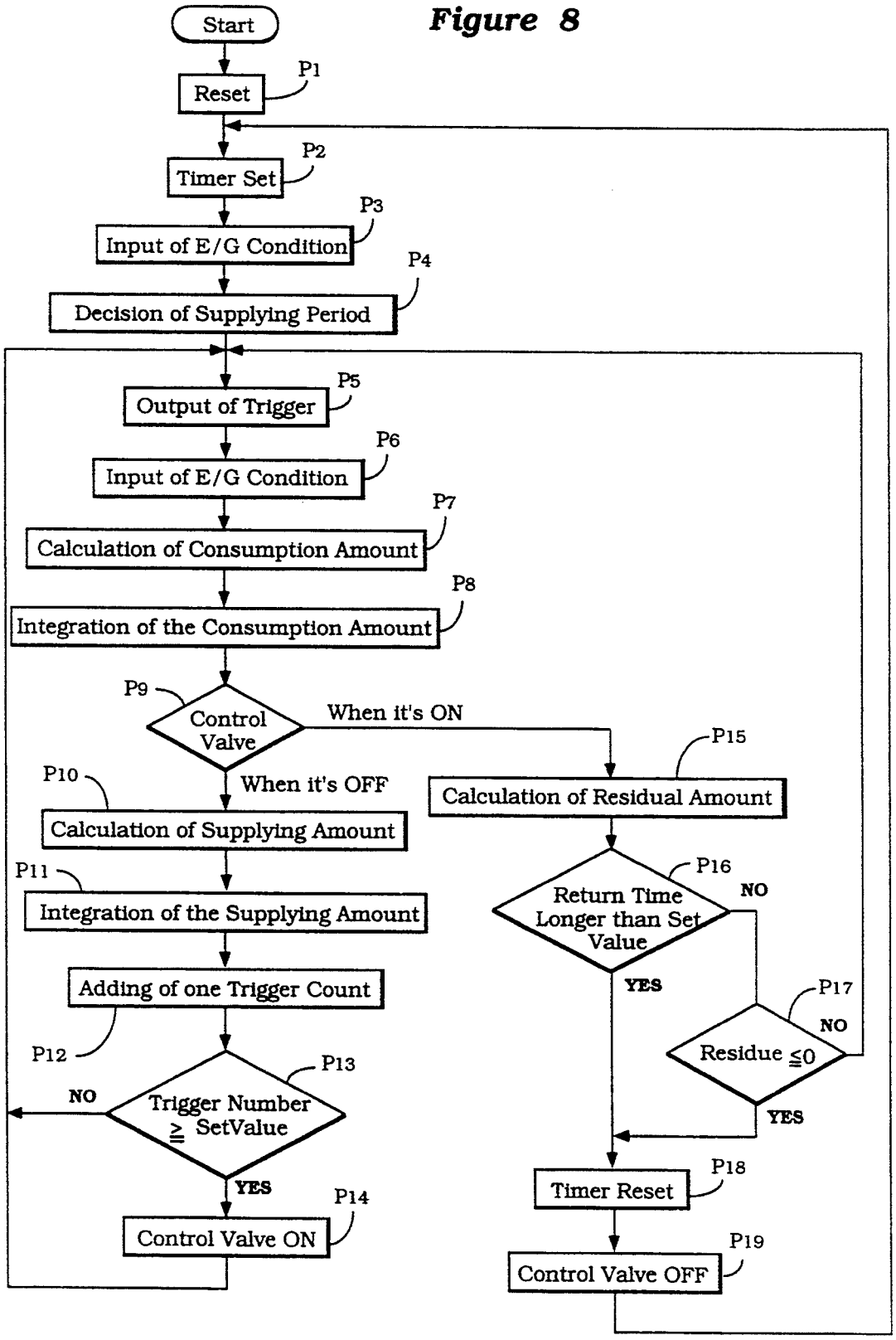
FIG. 8 is a block diagram showing the control routine.

Once the supply period has been determined at the step $P_4$ in accordance with the method set forth in FIG. 8, the program moves to the step $P_5$ (FIG. 8) to output a trigger signal in the timer 52 to begin counting. It should be noted that upon initial starting of the engine, the signal holding circuit 50 will be positioned in a condition so as to hold the solenoid 39 in its off position so that the control valve 27 will be supplying lubricant.

After the step $P_5$, the program moves to the step $P_6$ to immediately begin the calculation of the actual lubricant consumption and this is done by reading at first at the step $P_6$ the engine condition comprised of the engine speed r and the throttle valve position T. The program then moves to the step $P_7$ so as to calculate the actual amount of lubricant supplied. This is done by referring to the map of FIG. 4 to determine the actual engine speed and throttle opening at this time period and then to determine the amount of lubricant which will have been consumed by the engine during the time period for the timer to have one of its timed pulses. The program makes this calculation at the step $P_7$.

The program then moves to the step $P_8$ so as to add the amount of lubricant calculated at the step $P_7$ to the amounts of lubricant previously calculated as being consumed. The program then moves the step $P_9$ so as to determine if the control valve 27 is in its supplying, off condition or in its non-supplying, on condition.

Assuming at the step $P_9$ it has been determined that the control valve 27 is in its off condition so that it is supplying lubricant to the engine, the program then moves to the step $P_{10}$ to calculate the amount of lubricant being supplied. This is done by determining the initial supply condition as set at $P_4$ and then calculating the amount of lubricant supplied in the time period for one trigger pulse. The amount of lubricant thus supplied is then added to the previously supplied amount of lubricant calculated at the step $P_{11}$.

The program then moves to the step $P_{12}$ to add one trigger count to the counter of the timer 52.

The program then moves to the step $P_{13}$ to determine if the amount of lubricant called for at the supply period determination of step $P_4$ has been made by calculating the number of trigger pulses which have been set. If the timed number of pulses have been determined and set, the program then moves to the step $P_{14}$ so as to shut off the control valve 27 by energizing the solenoid 39 and stopping the supply of lubricant.

Assuming still that the program has moved through the steps $P_5$ through $P_{11}$ in that sequence, the program then returns to the step $P_5$ and repeats the continuation of the calculation of amount of lubricant consumed at the steps $P_5$ through $P_8$.

After these calculations have been made and assuming that the supply of lubricant has been stopped at the step $P_{14}$, the program then moves to the step $P_{15}$ so as to determine the amount of lubricant which has been supplied in excess of that being consumed. This is called the residual amount of lubricant and this calculation is made by the calculator 53.

The program then moves to the step $P_{16}$ to determine if the return time when the control valve is in its non-supply return condition is longer than the set time and if it is not, the program moves to the step $P_{17}$ to determine if there still is residual lubricant. That is, at the step $P_{17}$ the amount of lubricant supplied during the total supply period is compared with the amount of lubricant consumed and if lubricant residual is not less than or equal to zero, the program returns to the step $P_5$ to again calculate the amount of lubricant being consumed until the total amount of lubricant consumed is equal to that which has been supplied.

If, however, at the step $P_{16}$ it has been determined that the return time is longer than the set value, or that the amount of lubricant consumed has been equal to the amount supplied, the program then moves to the step $P_{18}$ so as to reset the timer and to the step $P_{19}$ to again begin lubricant supply by turning the solenoid winding 39 off and initiating the supply period of the control valve 27.

It should be readily apparent from the foregoing description that the control routine is very effective in maintaining the strict control over the amount of lubricant supplied to the engine by setting an initial supply period dependent upon the running condition at the time when lubricant supply is started, but by not reinstituting a new supply of lubricant to the engine until the actual running conditions of the engine indicate that the lubricant amount previously supplied has all been consumed. As a result, this system is extremely responsive to transient conditions and FIGS. 10–15 show specifically how the system responds to changed conditions of the engine.

Figure 10:
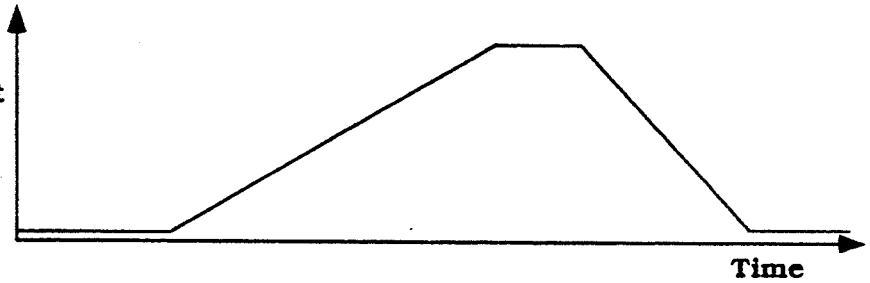
FIG. 10 is a graphical view showing the lubricant requirements of the engine in relation to time during a condition when the engine is maintained at idle, is accelerated gradually to full throttle, is held at full throttle for a time period and then is decelerated somewhat more rapidly than the acceleration back to idle.

FIGS. 10–15 are a graphical representation of how this control is achieved and depict a situation wherein the engine is operating at idle speed, is gradually accelerated to maximum speed and load, maintained there for a period and then decelerated, somewhat more rapidly than the acceleration, to idle speed. FIG. 10 shows the lubricant requirements under the various time conditions.

Figure 11:
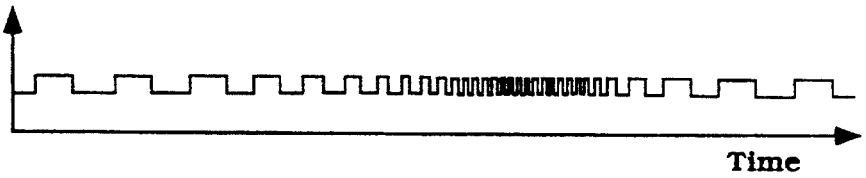
FIG. 11 is a graphical view, on the same time scale, showing the lubricant pump output.

As may be seen in FIG. 11, the pump output versus time is such that the number of pulses of the pump or pumping cycles are relatively low when the engine is operating at low speed, and increase in frequency as the speed increases and then again decrease in frequency as the speed decreases.

Figure 12:
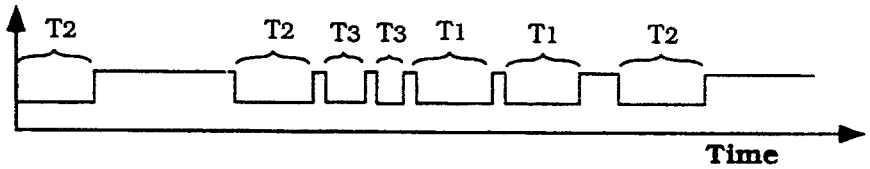
FIG. 12 is a graphical view, on the same time scale, showing the duty cycle of the solenoid valve of the lubricant control system.

FIG. 12 shows the on/off conditions of the solenoid valve during the running and the various "off" times $T_1$, $T_2$ and $T_3$ under the various running conditions. During idle and initial acceleration, the time period $T_2$ from the map of FIG. 4 is selected so as to provide minimum effect in variations in lubricant supply due to the opening and closing operation of the valve element 34. However, as the engine begins to accelerate, then the shorter time period $T_3$ is chosen so as to improve response to the transient condition. As the engine reaches its maximum speed and begins to decelerate, the longer time periods $T_1$ and $T_2$, respectively, are chosen.

Figure 13:
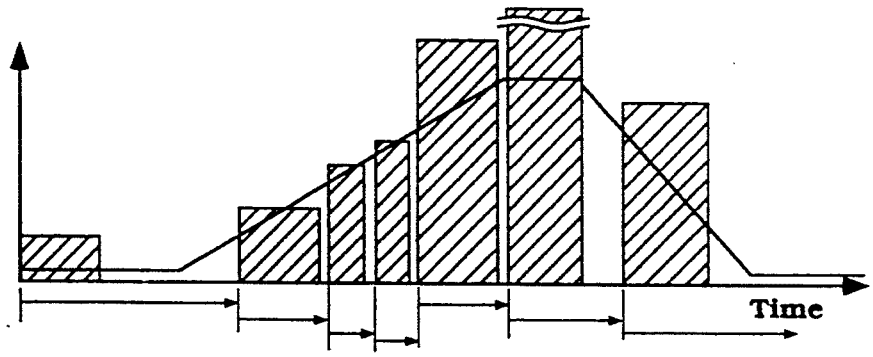
FIG. 13 is a graphical view, on the same time scale, showing the actual amount of lubricant supplied to the engine.
Figure 14:
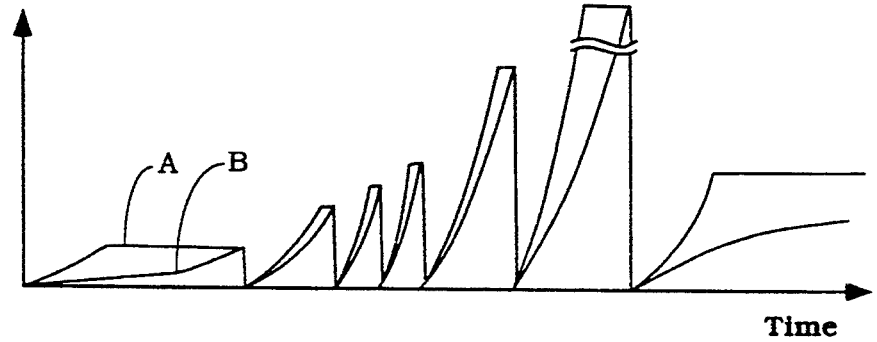
FIG. 14 is a graphical view showing the amount of lubricant supplied to the engine and the amount of lubricant actually consumed during the same time period.
Figure 15:
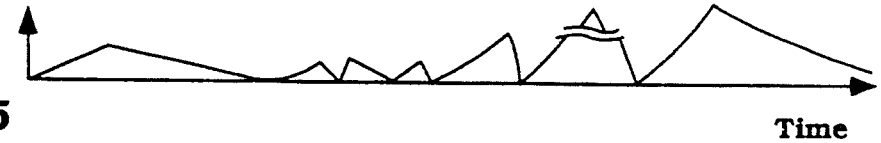
FIG. 15 is a graphical view showing the amount of residual lubricant in the engine.

The effect of this on the lubricant supply may be seen in FIG. 13 wherein the actual supply of lubricant to the engine is depicted. This lubricant supply occurs during the times when the solenoid winding 39 is de-energized and the control valve element 34 is in its lubricant supplying condition. As may be seen in FIG. 14, the integrated lubricant supply amount A and the use amount B are depicted while FIG. 15 shows the residual lubricant amount. It will be seen from these curves that the engine is only supplied with additional lubricant after the initial supply period when the running conditions indicate that the lubricant has all been consumed. As a result, extremely effective control over the lubricant amount is achieved and smoke in the exhaust and high hydrocarbon emissions will be avoided while, at the same time, ensuring that the engine receives adequate lubrication. Also, by changing the duration times of off time of the solenoid control valve 27 in response to engine conditions, it will be ensured that an accurate amount of lubricant is supplied while, at the same time, ensuring good responsiveness during times when transient conditions may be expected.

Figure 16:
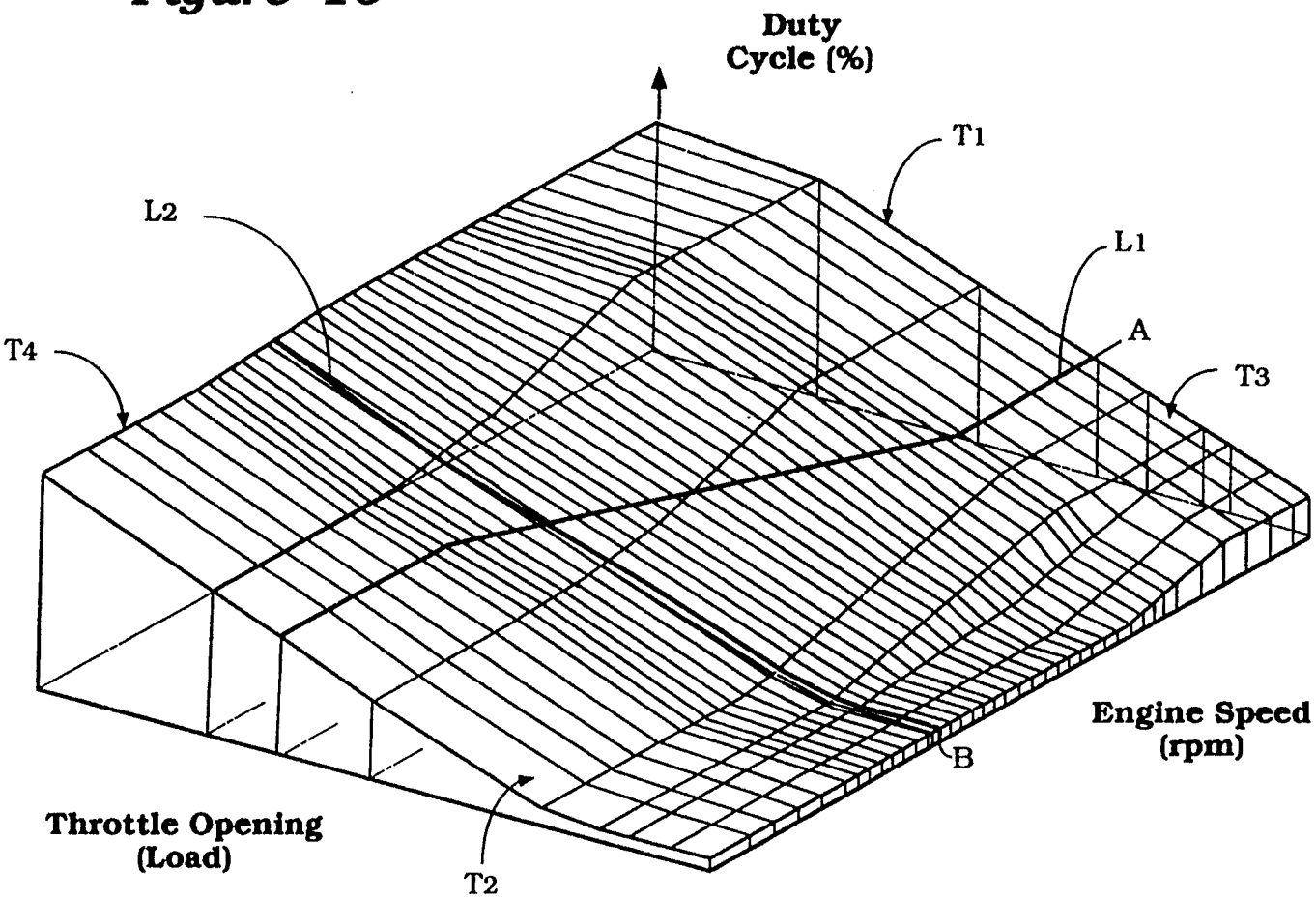
FIG. 16 is a map, in part similar to FIG. 4, and shows another map used in conjunction with another type of control strategy.
Figure 17:
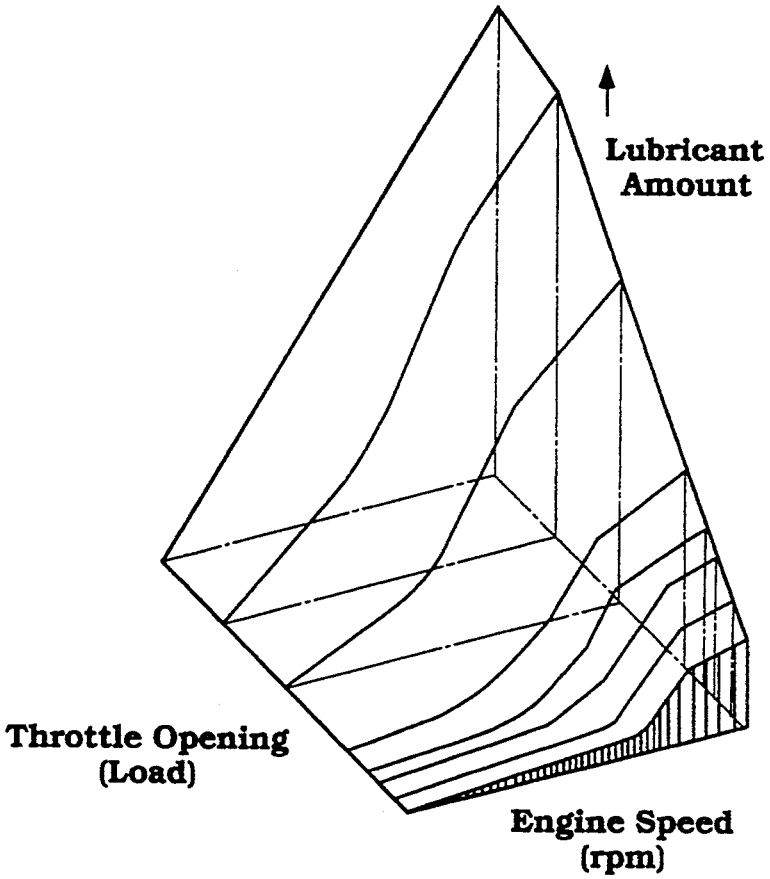
FIG. 17 is a graphical view showing the amount of fuel supplied in accordance with the map of FIG. 16.
Figure 18:
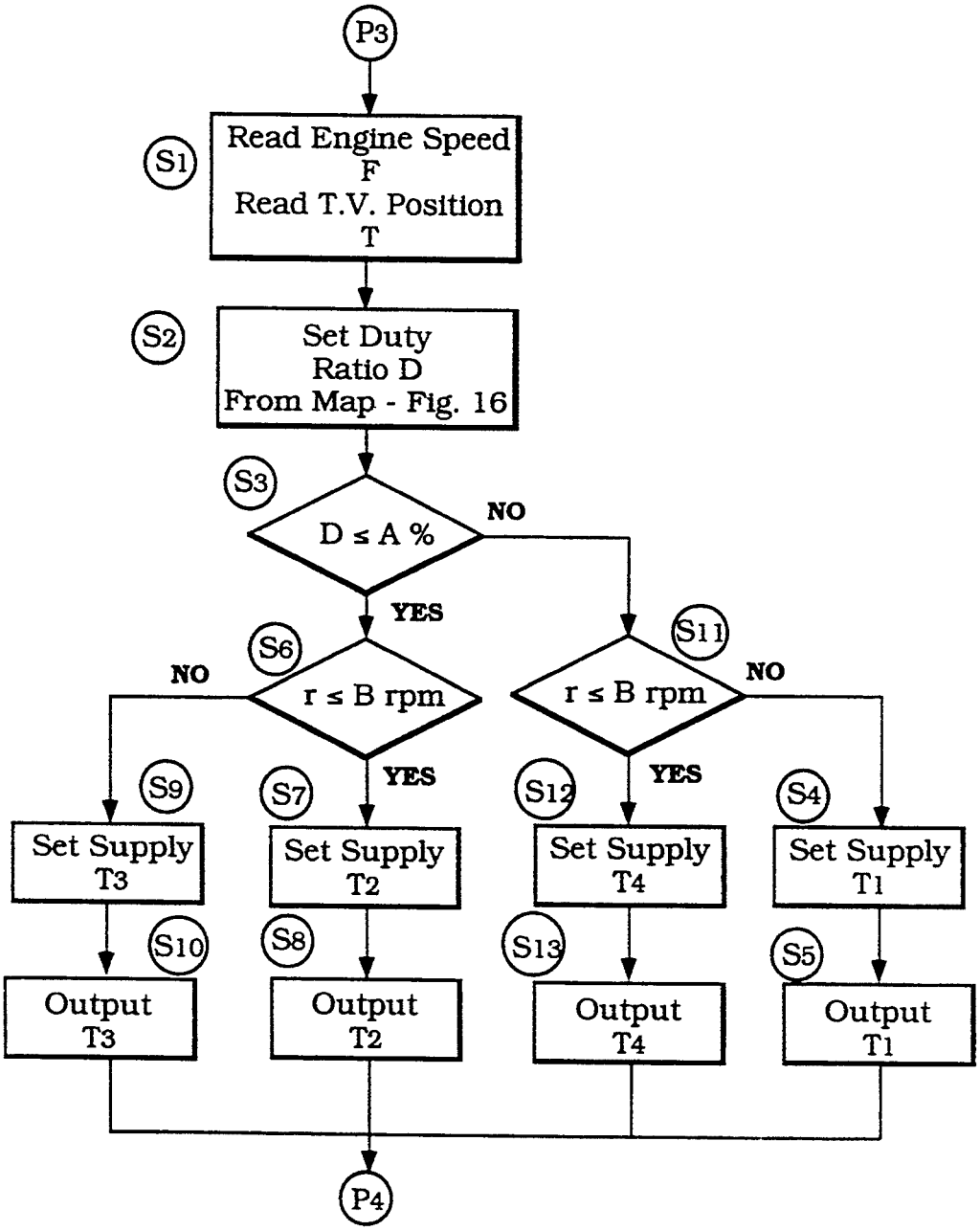
FIG. 18 is a block diagram showing how the duty cycle is set in accordance with this embodiment of the invention, and is in part similar to FIG. 7.

In the control routine of the embodiment as thus far described, there have been three main control phases during which the times T of supply of lubricant have been varied depending upon the engine running conditions. Of course, more than three control phases may be employed and FIGS. 16–18 show another embodiment of the invention wherein there are actually provided four control phases. Like the previously described embodiment, these control phases are determined by engine running conditions and set the actual time when the control valve 27 is maintained in its supply position.

Referring first to the map of FIG. 16, this map is similar to map of FIG. 4, but the control phases are divided into four control domains $T_1$, $T_2$, $T_3$ and $T_4$. The phase $T_1$ has a relatively long duration of the supply period of the control valve 27. This is similar to the corresponding period $T_1$ of FIG. 4 and lies in a domain between the planes $L_1$ and $L_2$ which are defined by the duty ratio line A and revolution speed line B. The control phase $T_3$ lies also between the lines A and B and the intersection between the planes $L_1$ and $L_2$ and also has a relatively short time period as with the previously described embodiment so as to accommodate transient conditions. A longer time period $T_2$, which may be similar to the time period $T_1$, lies in the domain at high throttle openings and low engine speeds where the planes $L_1$ and $L_2$ intersect. There is an added control period $T_4$ wherein the lubricant supply period is set even longer than the times $T_1$ or $T_2$ or $T_3$ and which is in the range of low throttle openings and low speed. This provides an even greater accuracy of lubricant supply under these conditions.

The control routine of this embodiment is basically the same as the control routine shown in FIG. 8 of the previously described embodiment. However, the control routine of FIG. 9 of that previous embodiment is replaced by the control routine of FIG. 18 wherein the respective domains $T_1$, $T_2$, $T_3$ or $T_4$ are selected. Therefore, in order to understand the control routine of this embodiment it is only necessary to describe that of FIG. 18 wherein the values $T_1$, $T_2$, $T_3$ or $T_4$ are determined. Certain steps of this routine are the same as the steps in FIG. 9 and where that is the case, these steps have been identified by the same step numbers.

As with before, at the step $S_1$ the engine speed r and throttle valve position T are read. The program then moves to the step $S_2$ so as to select the duty ratio D from the map of the FIG. 16. The program then, like the previous program, moves to the step $S_3$ to determine if the duty ratio D is less than or equal to the valve A. If the duty ratio is less than or equal to A, the program then moves to the step $S_6$, as with the previously described embodiment, to determine if the speed r lies on one side or the other of the speed line B. If it is equal to or less than the speed line B, the program moves to the step $S_7$ so as to select the supply time $T_2$ and to output this time $T_2$ at the step $S_8$ back to the program for the control.

If, on the other hand, the speed is above the speed B, the program moves to the step $S_9$ so as to set the supply time $T_3$ and at the step $S_{10}$ to output this supply time to the control unit.

If, however, the duty ratio D is not less than or equal to the ratio A, then the program must determine whether to apply the time $T_1$ or the time $T_4$ according to the map of FIG. 16. The program then moves to the step $S_{11}$ so as to determine if the engine speed is less than or equal to the speed of the curve B. If it is less than or equal to the speed B, the program moves to the step $S_{12}$ so as to set the supply time $T_4$ and at the step $S_{13}$ to output this time $T_4$. If, however, the engine speed r is not less than or equal to the speed B, the program moves to the step $S_4$, as previously noted, so as to set the supply time $T_1$ and output this time $T_1$ to the control.

As with the previously described embodiment, the map of FIG. 16 also has a flat area at high engine speeds and high throttle openings and a flat area at low engine speeds and low throttle openings. However, as with the previously described embodiment, the fact that the lubricant pump 24 is driven in timed relationship to the engine and hence varies the number of pumping cycles in response to engine speed, the lubricant supply curve of FIG. 17 will be generated and adequate and proper lubricant will be supplied under all conditions.

From the foregoing description it should be readily apparent that the described embodiments of the invention are very effective in providing accurate control of the amount of lubricant supplied to an engine and particularly to a crankcase compression two cycle internal combustion engine without supplying excess lubricant. Also, the system is very responsive to changes in conditions of the engine and hence can maintain good control even during the extremely difficult transient phases, which are common with internal combustion engines, particularly when applied to automotive or vehicular applications. Of course, the foregoing description is that of preferred embodiments of the invention and various changes and modifications may be made without departing from the spirit and scope of the invention, as defined by the appended claims.

We claim:

1. A lubricating system for an internal combustion engine comprising a lubricant pump, lubricant control means for controlling the amount of lubricant delivered by said lubricant pump to said engine, means for sensing the running condition of the engine, means for initiating a first supply of a predetermined amount of lubricant by said lubricant control means, said predetermined amount of lubricant being determined in response to a sensed condition of said engine sensed by said sensing means .prior to the initiation of the first lubricant supply, means for continuing to sense the running condition of the engine during the first supply of the predetermined amount of lubricant to the engine, and means for changing the condition of the supply of lubricant from said lubricant control means in response to predetermined changes in the engine conditions as sensed by said sensing means after the first predetermined lubricant supply has begun.

2. A lubricating system as set forth in claim 1 wherein the engine condition is speed.

3. A lubricating system as set forth in claim 1 wherein the engine condition is load.

4. A lubricating system as set forth in claim 3 wherein the engine condition also is speed.

5. A lubricating system as set forth in claim 1 wherein the control means controls the amount of lubricant delivered by changing a duty cycle of delivery of lubricant from the lubricant pump.

6. A lubricating system as set forth in claim 5 wherein the control means includes a valve for selectively supplying lubricant to the engine or for bypassing the lubricant back to a source of lubricant supply.

7. A lubricating system as set forth in claim 6 wherein the control valve operates so as to be maintained in its lubricant supply position in a failure mode.

8. A lubricating system as set forth in claim 6 wherein the engine condition is speed.

9. A lubricating system as set forth in claim 6 wherein the engine condition is load.

10. A lubricating system as set forth in claim 6 wherein the engine condition also is speed.

11. A lubricating system as set forth in claim 6 wherein the lubricant pump comprises a positive displacement pump that supplies a fixed amount of lubricant per cycle of operation.

12. A lubricating system as set forth in claim 11 wherein the lubricant pump is driven in timed relationship with the engine so that the number of pumping cycles of the lubricant pump varies with the engine speed.

13. A lubricating system as set forth in claim 12 wherein in addition to the duty cycle of the control means, the amount of lubricant supplied is controlled by varying the time when the control valve is in its lubricant supply condition.

14. A lubricating system as set forth in claim 13 wherein the time when the control valve is in its lubricant supply condition is maintained longer in response to certain running conditions than in response to other running conditions.

15. A lubricating system as set forth in claim 14 wherein the longer supply period is at high speed, high load conditions.

16. A lubricating system as set forth in claim 15 wherein the longer duration is also at low speed, low load conditions.

17. A lubricating system as set forth in claim 13 wherein the engine condition is speed.

18. A lubricating system as set forth in claim 13 wherein the engine condition is load.

19. A lubricating system as set forth in claim 18 wherein the engine condition also is speed.

20. A lubricating system as set forth in claim 19 wherein the duty cycle is determined from a map and wherein the map has flat portions under certain running conditions.

21. A lubricating system as set forth in claim 1 wherein the changing condition of the supply of lubricant from the lubricant control means comprises determining a time period after the completion of the delivery of the amount of lubricant supplied to the engine has elapsed before a further supply of an amount of lubricant to the engine by the control means is initiated.

22. A lubricating system as set forth in claim 21 wherein the time period is determined by the time the engine will consume the amount of lubricant supplied to the engine in the first supply amount as determined by the running condition of the engine after the supply of the first supply amount has been initiated to the engine.

23. A lubricating system as set forth in claim 22 wherein the engine condition is speed.

24. A lubricating system as set forth in claim 22 wherein the engine condition is load.

25. A lubricating system as set forth in claim 24 wherein the engine condition also is speed.

26. A lubricating system as set forth in claim 22 wherein the control means controls the amount of lubricant delivered by changing a duty cycle of delivery of lubricant from the lubricant pump.

27. A lubricating system as set forth in claim 26 wherein the control means includes a valve for selectively supplying lubricant to the engine or for bypassing the lubricant back to a source of lubricant supply.

28. A lubricating system as set forth in claim 27 wherein the control valve operates so as to be maintained in its lubricant supply position in a failure mode.

29. A lubricating system as set forth in claim 27 wherein the lubricant pump comprises a positive displacement pump that supplies a fixed amount of lubricant per cycle of operation.

30. A lubricating system as set forth in claim 29 wherein the lubricant pump is driven in timed relationship with the engine so that the number of pumping cycles of the lubricant pump varies with the engine speed.

31. A lubricating system as set forth in claim 30 wherein in addition to the duty cycle of the control means, the amount of lubricant supplied is controlled by varying the time when the control valve is in its lubricant supply condition.

32. A lubricating system as set forth in claim 31 wherein the time when the control valve is in its lubricant supply condition is maintained longer in response to certain running conditions than in response to other running conditions.

33. A lubricating system as set forth in claim 32 wherein the longer supply period is at high speed, high load conditions.

34. A lubricating system as set forth in claim 33 wherein the longer duration is also at low speed, low load conditions.

35. A lubricating system as set forth in claim 31 wherein the duty cycle is determined from a map and wherein the map has flat portions under certain running conditions.

36. A lubricating method for an internal combustion engine comprising a lubricant pump, lubricant control means for controlling the amount of lubricant delivered by said lubricant pump to said engine, said method comprising the steps of sensing the running condition of the engine, initiating a first supply of a predetermined amount of lubricant by said lubricant control means, said amount of lubricant being determined in response to a sensed condition of said engine sensed by said sensing means prior to the initiation of the first lubricant supply, and changing the condition of the supply of lubricant from said lubricant control means in response to predetermined changes in the engine conditions as sensed by said sensing means after the predetermined lubricant supply has begun.

37. A lubricating method as set forth in claim 3 wherein the engine condition is speed.

38. A lubricating method as set forth in claim 36 wherein the engine condition is load.

39. A lubricating method as set forth in claim 38 wherein the engine condition also is speed.

40. A lubricating method as set forth in claim 36 wherein the amount of lubricant delivered is controlled by changing a duty cycle of delivery of lubricant from the lubricant pump.

41. A lubricating method as set forth in claim 40 wherein the control includes a valve for selectively supplying lubricant to the engine or for bypassing the lubricant back to a source of lubricant supply.

42. A lubricating method as set forth in claim 41 wherein the control valve is maintained in its lubricant supply position in a failure mode.

43. A lubricating method as set forth in claim 41 wherein the engine condition is speed.

44. A lubricating method as set forth in claim 41 wherein the engine condition is load.

45. A lubricating method as set forth in claim 44 wherein the engine condition also is speed.

46. A lubricating method as set forth in claim 41 wherein the lubricant pump comprises a positive displacement pump that supplies a fixed amount of lubricant per cycle of operation.

47. A lubricating method as set forth in claim 46 wherein the lubricant pump is driven in timed relationship with the engine so that the number of pumping cycles of the lubricant pump varies with the engine speed.

48. A lubricating method as set forth in claim 47 wherein in addition to the duty cycle of the control means, the amount of lubricant supplied is controlled by varying the time when the control valve is in its lubricant supply condition.

49. A lubricating method as set forth in claim 48 wherein the time when the control valve is in its lubricant supply condition is maintained longer in response to certain running conditions than in response to other running conditions.

50. A lubricating method as set forth in claim 49 wherein the longer supply period is at high speed, high load conditions.

51. A lubricating method as set forth in claim 50 wherein the longer duration is also at low speed, low load conditions.

52. A lubricating method as set forth in claim 48 wherein the engine condition is speed.

53. A lubricating method as set forth in claim 48 wherein the engine condition is load.

54. A lubricating method as set forth in claim 53 wherein the engine condition also is speed.

55. A lubricating method as set forth in claim 54 wherein the duty cycle is determined from a map and wherein the map has flat portions under certain running conditions.

56. A lubricating method as set forth in claim 36 wherein the changing condition of the supply of lubricant from the lubricant control means comprises determining a time period after the completion of the delivery of the amount of lubricant supplied to the engine has elapsed before a further supply of an amount of lubricant to the engine is initiated.

57. A lubricating method as set forth in claim 56 wherein the time period is determined by the time the engine will consume the amount of lubricant supplied to the engine in the first supply amount as determined by the running condition of the engine after the supply of the first supply amount has been initiated to the engine.

58. A lubricating method as set forth in claim 57 wherein the engine condition is speed.

59. A lubricating method as set forth in claim 57 wherein the engine condition is load.

60. A lubricating method as set forth in claim 59 wherein the engine condition also is speed.

61. A lubricating method as set forth in claim 57 wherein the amount of lubricant delivered is changed by changing a duty cycle of delivery of lubricant from the lubricant pump.

62. A lubricating method as set forth in claim 61 wherein the control means includes a valve for selectively supplying lubricant to the engine or for bypassing the lubricant back to a source of lubricant supply.

63. A lubricating method as set forth in claim 62 wherein the control valve is maintained in its lubricant supply position in a failure mode.

64. A lubricating method as set forth in claim 62 wherein the lubricant pump comprises a positive displacement pump that supplies a fixed amount of lubricant per cycle of operation.

65. A lubricating method as set forth in claim 64 wherein the lubricant pump is driven in timed relationship with the engine so that the number of pumping cycles of the lubricant pump varies with the engine speed.

66. A lubricating method as set forth in claim 65 wherein in addition to the duty cycle of the control means, the amount of lubricant supplied is controlled by varying the time when the control valve is in its lubricant supply condition.

67. A lubricating method as set forth in claim 66 wherein the time when the control valve is in its lubricant supply condition is maintained longer in response to certain running conditions than in response to other running conditions.

68. A lubricating method as set forth in claim 67 wherein the longer supply period is at high speed, high load conditions.

69. A lubricating method as set forth in claim 68 wherein the longer duration is also at low speed, low load conditions.

70. A lubricating method as set forth in claim 66 wherein the duty cycle is determined from a map and wherein the map has flat portions under certain running conditions.

* * * * *